US006992441B2

(12) United States Patent
Glosser et al.

(10) Patent No.: US 6,992,441 B2
(45) Date of Patent: Jan. 31, 2006

(54) MBE GROWN ALKALI ANTIMONIDE PHOTOCATHODES

(75) Inventors: Robert Glosser, Plano, TX (US); Joseph P. Estrera, Dallas, TX (US); Loig E. Bourree, Dallas, TX (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 10/711,354

(22) Filed: Sep. 13, 2004

(65) Prior Publication Data

US 2005/0104517 A1 May 19, 2005

Related U.S. Application Data

(60) Provisional application No. 60/481,373, filed on Sep. 14, 2003.

(51) Int. Cl.
*H01J 40/06* (2006.01)
*H01J 40/14* (2006.01)

(52) U.S. Cl. ..... 313/542; 313/523; 313/527; 313/373; 313/532; 250/214 VT; 250/207

(58) Field of Classification Search ..... 313/542, 313/523, 527, 373, 532; 250/214 VT, 207
See application file for complete search history.

(56) References Cited

U.S. PATENT DOCUMENTS

| | | | | |
|---|---|---|---|---|
| 4,368,098 | A | 1/1983 | Manasevit | 156/606 |
| 4,896,035 | A * | 1/1990 | Mahoney et al. | 250/309 |
| 5,475,227 | A * | 12/1995 | LaRue | 250/397 |
| 5,962,843 | A | 10/1999 | Sinor et al. | 250/214 VT |
| 6,116,976 | A | 9/2000 | Sinor et al. | 445/28 |
| 6,121,612 | A | 9/2000 | Sinor et al. | 250/330 |
| 6,670,752 | B2 * | 12/2003 | Kinoshita et al. | 313/542 |
| 6,831,341 | B2 * | 12/2004 | Kan et al. | 257/431 |
| 2003/0001497 | A1 | 1/2003 | Kinoshita et al. | 313/532 |

OTHER PUBLICATIONS

A A Dowman, T H Jones and A H Beck, "Scanning Electron Diffraction Studies on Alkali Antimonide Photocahtodes, Including the S20", J. Phys. D: Appl. Phys., vol. 8, 1975, pp. 69-84.*

* cited by examiner

*Primary Examiner*—Mariceli Santiago
*Assistant Examiner*—Anthony Perry
(74) *Attorney, Agent, or Firm*—Marstellar & Associates, P.C.

(57) ABSTRACT

A photocathode manufacturing intermediary article (24) includes a substrate layer (26), and an active layer (20) that is carried by the substrate layer (26). The active layer (20) includes photoemissive alkali antimonide material that is epitaxially grown on the substrate (26).

14 Claims, 2 Drawing Sheets

MBE GROWN ALKALI ANTIMONIDE PHOTOCATHODES

CROSS REFERENCE TO RELATED APPLICATIONS

This application claims the benefit of U.S. Provisional Application Ser. No. 60/481,373, filed Sep. 14, 2003, entitled MBE GROWN ALKALI ANTIMONIDE PHOTOCATHODES.

BACKGROUND OF THE INVENTION

1. Technical Field

The invention relates to the field of photomultipliers, and more particularly, to an improved photocathode and a method for making the same.

2. Background Art

Photomultipliers and image intensifier devices employ a photocathode for conversion of photons to electrons. Microchannel plate image intensifiers are currently manufactured in two types that are commonly referred to as generation II (Gen II) and generation III (Gen III) type image tubes. The primary difference between these two types of image intensifiers lies in the type of photocathode employed.

Generation II image intensifier tubes have a polycrystalline multi-alkali photocathode, while generation III image intensifier tubes generally have a p-doped gallium arsenide (GaAs) photocathode that has been activated to negative electron affinity (NEA) by the adsorption of cesium and oxygen on the surface.

Existing photocathodes have several disadvantages. Generation III photocathodes are generally made using expensive processes such as metal/organic/chemical/vapor deposition (MOCVD) or molecular beam epitaxy (MBE). Compared to the prior techniques, the transparent matched substrate used in the present invention likely provides a cost advantage. Such production process is expensive and wasteful.

Additionally, the substrate and several of the subsequent growth layers of Gen III photocathodes must ultimately be wasted by being etched away in order to produce the actual Gen III photocathode. The Gen III photocathode must, by a separate process, also be attached to a window suitable for the wavelengths of interest.

Alkali antimonides have been the workhorses for photocathodes in photomultipliers and more recently GEN 2 image intensifiers starting with the discovery of $Cs_3Sb$ as a photoemitter in 1936. Since then, there have evolved a variety of materials, all polycrystalline small gap semiconductors, containing the alkali metals but all in the form $M_3Sb$ where M is either a single alkali or alkali alloy. The photoemissivity of members of this family are second only to the negative electron affinity (NEA) GaAs (GEN 3) photocathode.

Delft University of Technology and Dr. A. R. H. F. Ettema at that institution have shown only growth of $K_3Sb$:Cs on a vanadium substrate with no characterization to indicate epitaxy [Appl. Surf. Sci. 175–6, 101 (2001)]. Vanadium has a lattice constant of 3 Å. The lattice mismatch is too extreme for epitaxy to be likely.

While the above cited references introduce and disclose a number of noteworthy advances and technological improvements within the art, none completely fulfills the specific objectives achieved by this invention.

DISCLOSURE OF INVENTION

In accordance with the present invention, a photocathode manufacturing intermediary article includes a substrate layer, and an active layer. The active layer is carried by the substrate layer. The active layer further includes photoemissive alkali antimonide material that is epitaxially grown on the substrate.

The current growth techniques for alkali antimonides resulting in a polycrystalline layer significantly limit their photoemissivity. In contrast, with epi-growth of the present invention, the increased purity and single crystal growth is expected to greatly enhance the electron diffusion length of the materials; a key factor in high photoemissivity materials.

Epitaxially grown alkali antimonides may offer greater photoemissivity, not only in the infrared and visible but also in the ultraviolet.

These and other objects, advantages and feature of this invention will be apparent from the following description taken with reference to the accompanying drawings, wherein is shown the preferred embodiments of the invention.

BRIEF DESCRIPTION OF DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

MODE(S) FOR CARRYING OUT THE INVENTION

Figure 1:
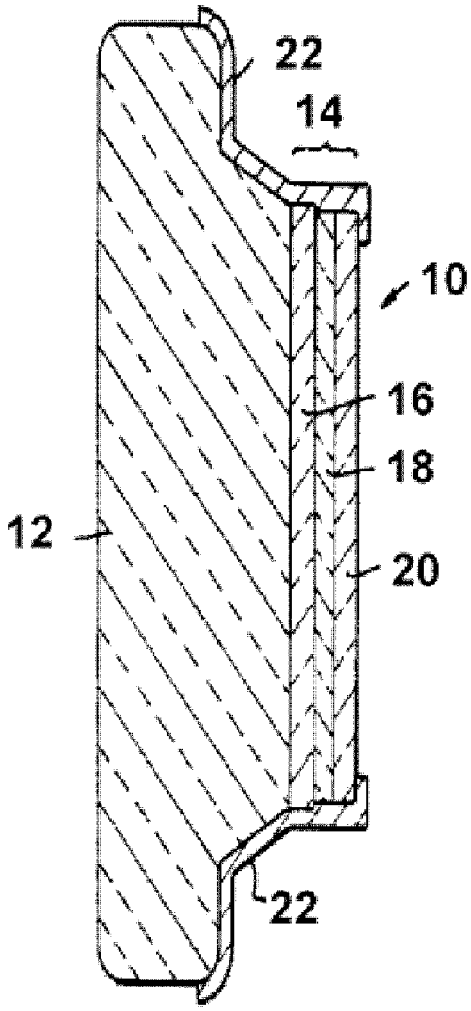
FIG. 1 is a cross sectional view of a first embodiment of a photocathode assembly.

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

A first embodiment of a photocathode 10 in overview (now particularly viewing FIG. 1) includes a transparent and supportive face plate portion 12, which may form the input window of a known type of image intensifier tube when this face plate is joined with other parts of the tube. The face plate portion 12 serves to support active portions of the photocathode 10, to transmit photons of light to the active portions of the photocathode 10, and to sealingly close a vacuum envelope of the image intensifier tube. Preferably, the face plate portion 12 is formed of glass, such as Corning 7056 glass or the like. This Corning 7056 glass may be used advantageously as the face plate portion 12 because its coefficient of thermal expansion closely matches that of other portions of the photocathode 10. Alternatively, other materials may be used for the face plate portion 12. For example, single-crystalline sapphire ($Al_2O_3$) might be used as the material for face plate portion 12. Thus, the present invention is not limited to user of any particular material for face plate portion 12.

Supported by the face plate portion 12 are the active portions of the photocathode 10, collectively generally indicated with the numeral 14. These active portions are configured as successive layers, each cooperating with the whole of the photocathode structure 10. More particularly, adjacent to the face plate 12 is an anti-reflection (and thermal bonding) coating 16 of silicon nitride and silicon dioxide. Upon this layer 16 is carried a window layer 18. The window layer 18 may be made of aluminum gallium arsenide (AlGaAs).

The window layer 18 serves to provide a structural transition between the glass face plate 12 and the crystalline structure of an active layer carried on the window layer 18. Additionally, the window layer serves as a potential barrier effectively "reflecting" thermalized electrons in the active layer back toward a crystal-vacuum interface at which photoelectrons are released into an image intensifier tube.

An active layer 20 as will be more fully discussed below is carried on window layer 18, and is responsive to photon of light to release photoelectrons. An electrode 22 is formed in the shape of a band or collar circumscribing the photocathode assembly 14, and provides electrical connection from a power supply in a completed image intensifier tube assembly to the active layer 20. Preferably, the electrode 22 is formed of chrome/gold alloy having advantages in the vacuum furnace brazing operation which is used to sealingly unite the components of tube, as those who are ordinarily skilled in the pertinent arts will understand. In other words, the photocathode assembly 10 seen in FIG. 1 will be sealingly united with other components of the tube of FIG. 1 to form a vacuum envelope within which photoelectrons and secondary emission electrons may freely move.

Figure 2:
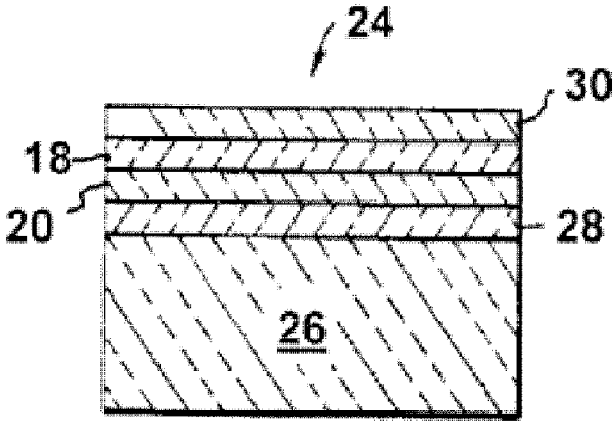
FIG. 2 provides a diagrammatic cross sectional view of a manufacturing intermediate product that is used to make a photocathode as seen in FIG. 1 and that also illustrates steps in the method of making such a photocathode.

Turning now to FIG. 2, a manufacturing intermediate article or product 24 used to make a photocathode assembly 10 as seen in FIG. 1 is depicted. Accordingly, the following description of the structure of the product 24 may also be taken as a description of the method steps used in making this product and the photocathode assembly 10. This manufacturing intermediate product 24 includes a substrate 26, a stop or buffer layer 28, active layer 20, window layer 18, and a protective cap layer 30. Preferably, the product 24 is fabricated using manufacturing methods, techniques, and equipment conventionally used in making GEN III image intensifier tubes. Accordingly, much of what is seen in FIG. 2 will be familiar to those ordinarily skilled.

The substrate 26 serves as a base upon which the layers 18, 20, 28, and 30 are grown epitaxially (not recited in the order of their growth on this substrate). Conventional fabrication processes such as MBE, which is conventional both to the semiconductor circuit industry and to the art of photocathodes, may be used to form the layers on substrate 26.

First, the stop layer 28 is formed of a suitable material, for example, aluminum gallium arsenide (AlGaAs). On this stop layer, the active layer 20 is formed, followed by window layer 18.

Finally, a cap layer 30 is grown on the active layer 28. This cap layer 30 may be formed of gallium arsenide, for example, and provides for protection of active layer 28 during cool down and subsequent transport of the manufacturing intermediate product 24 (i.e., which transport may include exposure to ambient atmospheric conditions) until further manufacturing steps complete its transition to a photocathode assembly as seen in FIG. 1 and subsequent sealing incorporation into an image intensifier tube.

As those ordinarily skilled will know, after the cap layer 30 is removed and coating 16 applied, the layers 18, 20, 26, and 28 are thermally bonded to the face plate 12, i.e., by thermal bonding of the layer 16 which serves as a thermal bonding layer also. Next, the stop layer 28 serves to prevent an etch operation which is used to remove the substrate 26 from etching into the active layer of the photocathode. Next, the stop layer 28 is selectively etched off, the electrode 22 is applied using standard thin-film techniques, the surface of active layer 20 is cleaned to remove oxides and moisture, and the photocathode assembly may activated.

Figure 3:
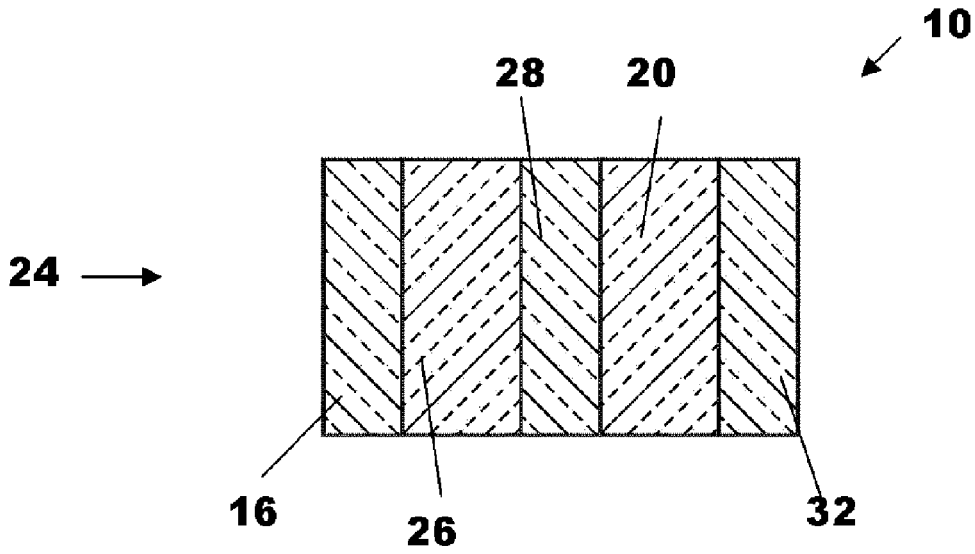
FIG. 3 is a cross sectional view of a second embodiment of a photocathode intermediate product.

A second embodiment of the intermediate product 24 for the photocathode 10 is shown in FIG. 3. Photocathode 10 of FIG. 3 includes a transparent and supportive faceplate, which is, in fact, the substrate 26 and may be joined with other portions of the image intensifier tube as is well known in the art. The faceplate acting as both substrate 26 and a window transmits photons to the active portions of the photocathode 10 and to sealingly close a vacuum envelope of the image intensifier tube (not shown).

The faceplate/substrate is preferably composed of the mineral, spinel or members of the spinel family. As stated above, the importance of spinel or related minerals is that its lattice constant is comparable to that of the active layer made of appropriate members of the alkali antimonide family.

Supported by the spinel 26 are the active portions of the photocathode 10. These active portions consist of a buffer layer 28 to facilitate quality growth of the active layer 20, whose composition may be some member of the alkali antimonide family. Following deposition of the buffer layer 28, the active layer 20 itself will be deposited. The exact composition depends on such variables as desired spectral sensitivity and desired quantum efficiency over some particular spectral region.

At this point the photocathode 10 is essentially complete except for the application of electrodes 22 and the like and can be incorporated into the tube assembly as is currently done for GEN III tubes. At some appropriate stage in the process, an antireflection (AR) 16 coating may be applied to the front surface of the spinel 26.

The production of this second embodiment of the photocathode is inherently simpler in terms of its structure and in terms of the processing steps required to produce it.

Optionally, an antireflection coating 16 may be applied on the front surface of the spinel substrate. Also, a Cs—$CsO_x$ layer 32 is deposited on the surface of the alkali antimonide active layer in order to promote negative electron affinity (NEA). As previously suggested, a buffer layer 28 may initially be placed on the spinel substrate prior to growth of the active layer to enhance the quality of the growth of the active layer.

Commercially, the alkali antimonide photocathodes have been invariably grown as thin polycrystalline films on glass, quartz or $MgF_2$ windows. This is in strong contrast to the careful single crystal growth of NEA GaAs onto GaAs substrates.

The current growth techniques for alkali antimonides significantly limit their photoemissivity. In contrast, with epi-growth of the present invention, the increased purity and single crystal growth is expected to greatly enhance the electron diffusion length of the materials; a key factor in high photoemissivity materials.

Alkali antimonides are to be grown by molecular beam epitaxy (MBE) on substrates 26 closely lattice matched to the alkali antimonides used in the active layer 20.

The mineral spinel ($MgAl_2O_4$) with a lattice constant of 8.083 Å as well as other members of the spinel family are appropriate epitaxial substrate materials for the MBE growth of the alkali antimonide family. The range of lattice constants for the alkali antimonides used in the active layer 20 extends from 7.73 to 9.18 Å.

The alkali antimonides have both a cubic and hexagonal phase. Cubic is a preferred phase for photoemission. Spinel also forms in a cubic structure.

In addition to its suitability as an epitaxial growth substrate 26, spinel is transparent into the ultraviolet and may be into at least the near infrared. Consequently, such a substrate 26 is automatically eligible to be a window layer for transmission mode image intensifiers. This possibility of direct epitaxial growth on the window layer 26 suggests great savings of labor and material. This alternative embodiment is to be compared with current technology for GEN 3 where the GaAs substrate must be etched away and there is whole bonding procedure required for attaching the growth layer to a glass window as described above.

Epitaxially grown alkali antimonides may also offer greater photoemissivity, not only in the infrared and visible but also in the ultraviolet.

Besides increased photoemissivity, the alkali antimonides offer the possibility of a new family of small direct and indirect gap semiconductors for device applications. These include detectors, infrared lasers, and possibly, transport devices such as transistors. Also, $Li_3Sb$ and $Li_2CsSb$ may have enhanced photoemissive properties and therefore suitable for fabrication.

The present invention should have the quantum efficiency obtained by Gen III photocathodes, but with a significantly less wasteful production process. Not only is the spinel the substrate for growth of the photocathode, but it is, optionally, a suitable window. Thus the technique for preparing a photocathode tube is greatly simplified in that the epitaxial growth occurs directly on the window. There is no longer a need to waste expensive material, nor is there need for separately attaching a window.

A major advantage of the present invention includes the increased diffusion length, greater purity, and greater control of the growth process with an increase in the quantum efficiency so as to equal or surpass that from the Gen III device.

The foregoing disclosure and description of the invention are illustrative and explanatory thereof, and various changes in the size, shape and materials, as well as in the details of the illustrated construction may be made without departing from the spirit of the invention.

What is claimed is:

1. A photocathode manufacturing intermediary article comprising:

a crystal substrate suitable for single crystal growth thereon;

an active layer carried by the crystal substrate, the active layer including photoemissive alkali antimonide material epitaxially grown as a single crystal on the substrate; and, the crystal substrate having a lattice constant aprroximately equal to the lattice constant of the active layer.

2. The invention of claim 1 wherein the crystal substrate includes spinal.

3. The invention of claim 2 wherein the spinal has a lattice constant of 8.083 Å.

4. The invention of claim 1 wherein the alkali antimonide material is in a cubic phase.

5. The invention of claim 1 wherein the alkali antimonide material has a lattice constant between 7.73 and 9.18 Å.

6. The invention of claim 1 wherein the substrate is transparent to light in a desired wavelength range.

7. The invention of claim 1 wherein the substrate is composed of a member from a family of materials including spinal.

8. A method for making a photocathode manufacturing intermediary article comprising:

forming a single crystal active layer carried by crystal substrate suitable for single crystal growth thereon, the active layer including photoemissive alkali antimonide material epitaxially grown on the crystal substrate; and, the crystal substrate having a lattice constant approximately equal to the lattice constant of the active layer.

9. The method of claim 8 wherein the crystal substrate includes spinal.

10. The method of claim 9 wherein the spinel has a lattice constant of 8.083 Å.

11. The method of claim 8 wherein the alkali antimonide material is in a cubic phase.

12. The method of claim 8 wherein the alkali antimonide material has a lattice constant between 7.73 and 9.18 Å.

13. The method of claim 8 wherein the substrate is transparent to light in a desired wavelength range.

14. The method of claim 8 wherein the substrate is composed of a member from a family of materials including spinel.

* * * * *